US005368007A

United States Patent [19]

Carroll

[11] Patent Number: 5,368,007

[45] Date of Patent: Nov. 29, 1994

[54] AIRGUN EXPANSION CHAMBER

[75] Inventor: Kent L. Carroll, Darien, Ill.

[73] Assignee: Air America, Glenview, Ill.

[21] Appl. No.: 105,427

[22] Filed: Aug. 13, 1993

[51] Int. Cl.[5] ..... F41B 11/00

[52] U.S. Cl. ..... 124/56; 124/1; 124/80; 62/50.5; 96/208

[58] Field of Search ..... 124/56, 71, 73–76, 124/58, 60, 69–70, 80, 1; 96/208, 216, 220; 210/188; 62/50.5

[56] References Cited

U.S. PATENT DOCUMENTS 4,376,676 3/1983 Gill ..... 96/216 X
5,330,641 7/1994 Cattani ..... 96/208 X

FOREIGN PATENT DOCUMENTS 2124929 2/1984 United Kingdom ..... 96/208
9215386 9/1992 WIPO ..... 96/208

*Primary Examiner*—Randolph A. Reese
*Assistant Examiner*—Harry C. Kim
*Attorney, Agent, or Firm*—Robert J. Black

[57] ABSTRACT

An expansion chamber with a connection to an airgun employing carbon dioxide or similar gas as a propellant. The expansion chamber is normally connected to a source of liquified gas, included therein is a structure for separating liquified gas into the gaseous state for use as a propellant. Any remaining liquid portion is retained until it is converted into the gaseous state.

9 Claims, 1 Drawing Sheet

AIRGUN EXPANSION CHAMBER

BACKGROUND OF THE INVENTION

1. Field of the Invention

The present invention pertains to airguns and more particularly to a gas expansion chamber for use with carbon dioxide powered airguns.

2. Background Art

The advantages of the use of carbon dioxide gas as a propellant in airguns is a well known and accepted practice. Such carbon dioxide gas is generally stored in a liquid state. Inasmuch as most airguns perform best when the propellant that is used is exclusively in a gaseous state, the actual product delivered from high pressure carbon dioxide (CO2) storage vessels is a variable mixture of liquid and gaseous CO2. The liquid content of CO2 within a storage vessel creates a problem. The liquid to gas proportion of the mix varies depending upon the attitude or position of the storage vessel, as well as such things as the amount of agitation caused by handling of the airgun or the storage vessel and also ambient temperature conditions.

In addition to the problems caused by liquid CO2 as outlined above, an additional problem referred to as "aerosol supercharging" frequently exists. Aerosol supercharging occurs when the airgun ingests a propellant mix that consists of gaseous CO2 with droplets of liquid CO2 suspended within the gas stream. With this mixture present in the valve chamber of an airgun, the droplets can, depending upon variables like temperature and rate of fire, convert to a gaseous state and thereby substantially elevate pressure within the valve chamber. Such increases in pressure create unacceptable velocity variations and may also result in both poor accuracy and unsafe operating conditions.

An attempt at solving this problem has been met by some individuals installing long lengths of high pressure hose between the supply vessel and the valve chamber of the airgun. The theory being that the liquid CO2 transversing the length of the hose will make the transition from a liquid to a gaseous state. It has been generally found and accepted that this approach to the problem has been largely ineffective inasmuch as substantial amounts of liquid CO2 still are able to enter the valve chamber of the airgun.

Other efforts to deal with the problem have involved remounting a supply vessel into particular orientations that are intended to minimize the amount of liquid propellant that exits in the supply vessel. Such attempts have frequently created relationships between the airgun and supply vessel combination that ergonomically or aesthetically are unacceptable or undesirable.

In a search of the background art directed to the subject matter of the present invention conducted in the U.S. Patent and Trademark Office, no patents were found relating to the use of expansion chambers for carbon dioxide powered airguns. The only expansion chamber found was included in a process and apparatus for producing and using cold ammonia as a fertilizer as taught in U.S. Pat. No. 4,069,029 which issued on Jan. 17, 1978 to John William Hudson. This patent teaches the introduction of a stream of ambient temperature pressurized liquid ammonia at high velocity into an expansion chamber. A mist eliminator located within the expansion chamber eliminates suspended droplets of cold liquid ammonia in the cold gaseous ammonia stream passing into the chamber. Hudson teaches the use of a stationary blade as a mist eliminator because of its inherent simplicity, compactness and light weight. After a thorough review of the above identified patent, it is believed that it neither teaches, discloses or claims the novel combination of elements and functions found in the improved airgun expansion chamber taught by the present invention.

SUMMARY OF THE INVENTION

The expansion chamber of the present invention consists of a small unit that threads onto existing standard C.G.A. fittings on an airgun. In practice, it consists of two sections, an inner support strut or unit which includes a helical baffle and a gas delivery port keyed into this inner portion or strut. This strut also includes the necessary threading for attachment to an airgun. The other portion consists of an outer sleeve which slides over the inner strut to form the completed expansion chamber. Sealing between the strut and this outer or sleeve portion is accomplished by a number of O ring sites.

Accordingly, it has been found that the expansion chamber unit of the present invention is effective in meeting the problems caused by the periodic introduction of liquid propellant caused by handling or orientation of the airgun or CO2 container as well as aerosol supercharging. In practice, the CO propellant from its supply vessel enters the expansion chamber at the middle of the chamber body through a small diameter orifice. The size of this orifice is critical in that it is intended to create a "spray nozzle" effect as the propellant enters the unit. At this point a liquid to gas transition is enhanced by the pressure variations produced by the gas stream passing from a small orifice into the large volume internal chamber of the expansion chamber unit.

A lower portion of the expansion chamber unit, below the inlet orifice, is configured to provide a sump to allow for the accumulation of liquid CO2 that may be delivered to the unit due to handling or orientation. This most important feature of the unit, the inclusion of a liquid sump, allows for accumulation of liquid propellant while at the same time keeping accumulated liquid out of the direct path of the gas flow. This arrangement keeps the accumulated liquid from being splashed and aerated by the subsequent pulses of gas passing through the system. If this were not done, any liquid reposing in the sump unit would be aerated and would dramatically contribute to the problem of aerosol supercharging.

Above the inlet orifice, a helical gas baffle is included. This baffle causes a circular gas flow, which in turn creates a centrifugal filtering action. This circular gas flow in turn has the effect of moving any suspended droplets of liquid CO2 outward, depositing them on the inner surface of the outer sleeve of the expansion chamber, away from the centrally located exit port that supplies gas to the airgun. These droplets that are deposited on the inner surface of the outer sleeve then run down into the sump area. In this manner, the unit essentially eliminates aerosol supercharging.

DETAILED DESCRIPTION OF THE PREFERRED EMBODIMENT

Figure 1:
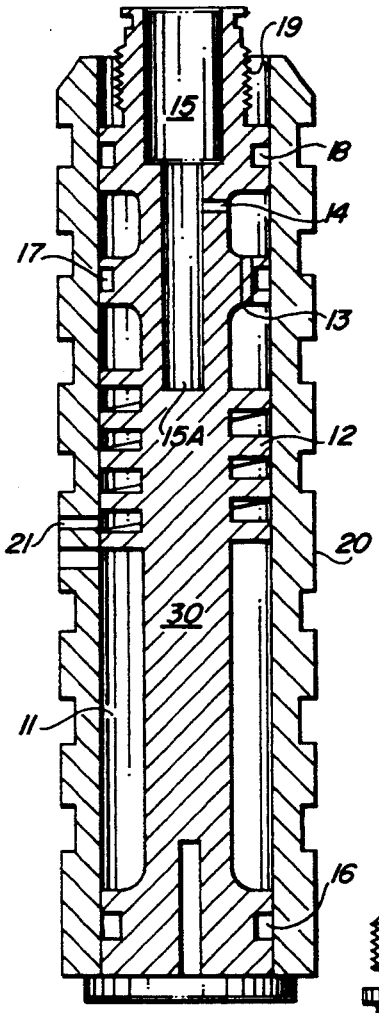
FIG. 1 is a cross section of an expansion chamber for use with airguns in accordance with the present invention.
Figure 2:
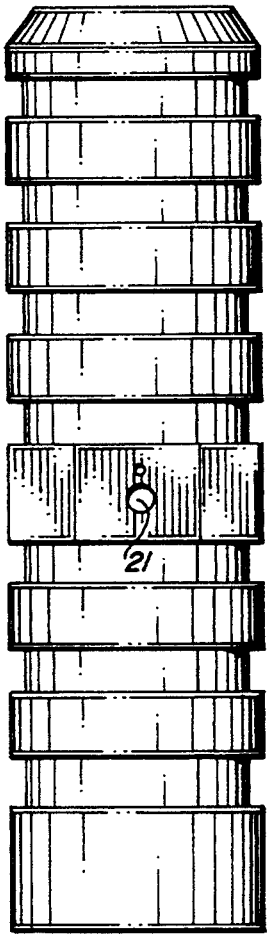
FIG. 2 is a outer or sleeve portion of an expansion chamber in accordance with the present invention.

Referring now to FIGS. 1–4 of the accompanying drawings, the expansion chamber of the present invention will be described. The outer or sleeve portion 20 as seen in FIGS. 1 and 2 is essentially hollow and is constructed of aluminum or in the alternative such material as transparent borosilicate glass. Included in the outer sleeve 20 is orifice 21 which facilitates connection to a "banjo" type fitting to an external CO2 repellant storage container.

Figure 3:
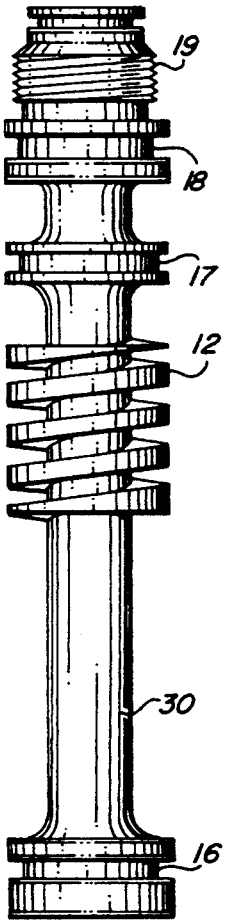
FIG. 3 is the inner or center strut portion of an expansion chamber for use with airguns as taught by the present invention.
Figure 4:
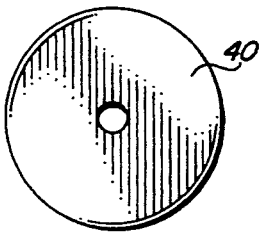
FIG. 4 is a top view of a retaining cap useful for retaining the inner portion or center strut of the expansion chamber within the outer sleeve of the expansion chamber.

The inner section or strut 30, as seen in FIGS. 1 and 3 provides, when combined with outer sleeve 20 a main sump 11 or reservoir for liquid CO2, a helical baffle 12 is located approximately midway up the strut. A partition above the helical baffle 12 including a partition opening 13 provides access to a transfer orifice 14 which leads into an auxiliary sump 15A included within the strut 30. Secure mating between the strut 30 and the outer sleeve 20 is provided by means of O rings inserted at retention sections 16, 17 and 18. The strut is further retained within the outer sleeve by means of retaining cap 40 which maintains the strut in the appropriate location within sleeve 20. Retaining cap 40 may be secured to strut 30 by thread or pressure fit means, the securing details do not form a part of the present invention. Threads 19 at the top of strut 30 facilitate the placement of the unit on an airgun inasmuch as the threads are adapted to mate with a standard C.G.A. fitting found on all applicable airguns.

A further understanding of the present invention may be had by the following operational summary. Initially, the center strut 30 is attached to an airgun at the standard C.G.A. fitting as noted above. After which sleeve 20 is passed over strut 30 and with retaining cap 40 providing retention of the outer sleeve 20 in position on strut 30. Neoprene O rings installed on center strut 30 at locations 16, 17 and 18 provide a gas tight, snug fit between strut 30 and sleeve 20. An external source of liquified CO2 in a container is fastened to the expansion chamber of the present invention at orifice 21 by means of a "banjo" type fitting. The details of that fitting do not form a portion of the present invention. As the contents of the CO2 storage container are released, they enter the expansion chamber through the calibrated orifice 21. As the gas passes through this orifice into the larger internal volume of the expansion chamber, a pressure reduction point is created, enhancing the tendency of any liquid CO2 to immediately convert into gas. Once the gas stream has entered the lower portion of the expansion chamber, the liquid CO2 will migrate into the main sump area 11 as a result of gravity. This liquid collecting in sump 11 will eventually convert to a gaseous state in the normal course of operation. The gaseous portion of the incoming stream will move upward through the unit rising past the helical baffle 12 which introduces a circular flow pattern. This in turn creates a centrifugal filtering action. Such action will cause any suspended CO2 droplets to be deposited on the inner surface of the outer sleeve 20. Such liquid CO2 droplets so deposited then run down the surface of outer sleeve into main sump 11.

The thus purified gas stream continues to pass in an upward direction through partition opening 13 which also has a controlled size. The partition in which the opening 13 is located provides a partial liquid transfer protection for the airgun should the entire lower section of the expansion chamber become completely flooded with liquid CO2 due to gross mishandling. This baffle blocks large scale splashes and surges of liquid from passing through the system directly to the gun. The gas stream, as indicated, passes through the partition opening 13 into a transfer orifice 14 into the internal central cavity 15. The internal central cavity 15 is configured also to create a small internal auxiliary sump 15A. This auxiliary sump 15A is intended to help the unit deal with the same gross flooding that the partition baffle was designed to counter. Under normal operation, no liquid would be present within auxiliary sump 15A. The gas at this portion now rises to the upper portion of the expansion chamber directly through the standard fitting into the airgun upon which the expansion chamber of the present invention has been inserted. The gas is now available to the airgun inasmuch as this was the exit point from the expansion chamber unit.

While but a single embodiment of the present invention has been shown, it will be obvious to those skilled in the art that numerous modifications may be made without departing from the spirit of the present invention, which shall be limited only by the scope of the claims appended hereto.

What is claimed is:

1. An expansion chamber for use between a source of liquified gas and an airgun, utilizing said gas as a propellant, said expansion chamber comprising:

a sleeve portion including an inner surface and an outer surface;

an orifice extending from said outer surface to said inner surface;

a strut portion positioned within said sleeve portion;

a first sump for said liquified gas formed by a combination of said sleeve portion and a lower section of said strut portion;

said strut portion further including a helical baffle section located above said first sump;

a partition extending from said strut portion to said sleeve portion inner surface;

an opening extending through said partition;

said strut portion further including an outlet section including a connection to said opening and means for connecting said expansion chamber to said airgun;

whereby said liquified gas introduced into said expansion chamber is converted to a gaseous state and passes through said expansion chamber to said connected airgun.

2. An expansion chamber as claimed in claim 1 wherein:

said strut portion is retained within said sleeve portion by means of a retaining cap secured to a bottom portion of said strut.

3. An expansion chamber as claimed in claim 1 wherein:

said strut portion further includes a plurality of O ring retention means.

4. An expansion chamber as claimed in claim 3 wherein:

said expansion chamber further includes a plurality of neoprene O rings positioned in said O ring retaining means to provide a gas tight seal between said strut portion and said sleeve portion.

5. An expansion chamber as claimed in claim 1 wherein:

said orifice extending from said outer surface to said inner surface of said sleeve portion is of a predetermined size to facilitate a conversion of said liquified gas into the gaseous state.

6. An expansion chamber as claimed in claim 1 wherein:

said outlet section further includes a second sump.

7. An expansion chamber as claimed in claim 1 wherein:

said sleeve portion is constructed of aluminum.

8. An expansion chamber as claimed in claim 1 wherein:

said sleeve portion is constructed of transparent borosilicate glass.

9. An expansion chamber as claimed in claim 1 wherein:

said means for connecting said expansion chamber to said airgun comprise a plurality of threads adapted to engage a standard C.G.A. airgun fitting.

* * * * *